US010147536B2

(12) United States Patent
Yoshikawa et al.

(10) Patent No.: US 10,147,536 B2
(45) Date of Patent: Dec. 4, 2018

(54) REACTOR

(71) Applicants: AutoNetworks Technologies, Ltd., Yokkaichi, Mie (JP); Sumitomo Wiring Systems, Ltd., Yokkaichi, Mie (JP); Sumitomo Electric Industries, Ltd., Osaka-shi, Osaka (JP)

(72) Inventors: Kouhei Yoshikawa, Mie (JP); Seiji Shitama, Mie (JP); Takashi Takada, Mie (JP); Shintaro Nanbara, Mie (JP)

(73) Assignees: AutoNetworks Technologies, Ltd., Yokkaichi, Mei (JP); Sumitomo Wiring Systems, Ltd., Yokkaichi, Mei (JP); Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 15/524,205

(22) PCT Filed: Oct. 23, 2015

(86) PCT No.: PCT/JP2015/079952
§ 371 (c)(1),
(2) Date: May 3, 2017

(87) PCT Pub. No.: WO2016/072295
PCT Pub. Date: May 12, 2016

(65) Prior Publication Data

US 2017/0338032 A1 Nov. 23, 2017

(30) Foreign Application Priority Data

Nov. 7, 2014 (JP) ..... 2014-226848

(51) Int. Cl.
*H01F 27/30* (2006.01)
*H01F 27/02* (2006.01)
(Continued)

(52) U.S. Cl.
CPC ..... *H01F 27/32* (2013.01); *H01F 27/022* (2013.01); *H01F 27/324* (2013.01); *H01F 37/00* (2013.01)

(58) Field of Classification Search
CPC ..... H01F 27/32; H01F 27/02; H01F 27/022; H01F 27/22; H01F 27/325; H01F 27/2847; H01F 37/00; H01F 5/02; H01F 2005/027
(Continued)

(56) References Cited

U.S. PATENT DOCUMENTS

2010/0226410 A1* 9/2010 Maeno ..... H01F 27/402 374/208
2013/0038415 A1 2/2013 Ooishi et al.
(Continued)

FOREIGN PATENT DOCUMENTS

JP 2011060915 A 3/2011
JP 2011243943 A 12/2011
(Continued)

*Primary Examiner* — Mangtin Lian
(74) *Attorney, Agent, or Firm* — Honigman Miller Schwartz and Cohn LLP

(57) ABSTRACT

Provided is a reactor that can be manufactured without holding an assembly when the assembly is fixed to a mounting plate via a bonding layer. The reactor includes a coil, a magnetic core, an interposed insulating member, a metal mounting plate, and a bonding layer. The interposed insulating member is provided with an inwardly interposed portion, a first interposed end face portion, and a second interposed end face portion. The interposed insulating member is obtained by combining a plurality of divided pieces that includes a divided piece having the first interposed end face portion, and a divided piece having the second interposed end face portion. The divided pieces are respectively provided with engaging portions that engage with each other, and the first interposed end face portion and the
(Continued)

second interposed end face portion are each provided with a leg piece that separates the coil from the mounting plate.

13 Claims, 9 Drawing Sheets

(51) Int. Cl.
*H01F 27/08* (2006.01)
*H01F 27/32* (2006.01)
*H01F 37/00* (2006.01)

(58) Field of Classification Search
USPC ..... 336/198, 208, 90, 96, 212, 184, 178
See application file for complete search history.

(56) References Cited

U.S. PATENT DOCUMENTS

| | | | | |
|---|---|---|---|---|
| 2013/0088317 | A1* | 4/2013 | Tawara | H01F 17/06 336/212 |
| 2013/0182478 | A1* | 7/2013 | Nomura | H01F 27/022 363/123 |
| 2015/0043262 | A1 | 2/2015 | Ito et al. | |
| 2015/0287525 | A1 | 10/2015 | Yamada et al. | |

FOREIGN PATENT DOCUMENTS

| | | | |
|---|---|---|---|
| JP | 2013004531 | A | 1/2013 |
| JP | 2013175566 | A | 9/2013 |
| JP | 2014093375 | A | 5/2014 |

* cited by examiner

REACTOR

CROSS-REFERENCE TO RELATED APPLICATIONS

This application is the U.S. national stage of PCT/JP2015/079952 filed Oct. 23, 2015, which claims priority of Japanese Patent Application No. JP 2014-226848 filed Nov. 7, 2014.

TECHNICAL FIELD

The present invention relates to a reactor that is used in, for example, constituent components of in-car DC-DC converters or electric power conversion devices that are installed in electric-powered vehicles such as hybrid cars.

BACKGROUND

Magnetic components such as reactors and motors that are provided with: a coil that has a wound portion obtained by winding a coil wire; and a magnetic core, a part of which is inserted into the wound portion, are used in various fields. As such a magnetic component, a reactor for use in a circuit component of a converter that is installed in electric-powered vehicles such as hybrid cars is disclosed in JP 2011-243943A 1, for example.

JP 2011-243943A 1 discloses a reactor in which an assembly obtained by assembling a coil, a magnetic core, and an insulator (interposed insulating member) that ensures insulation between the coil and the magnetic core is accommodated in a casing. JP 2011-243943A 1 discloses that an installation surface portion (mounting plate), which is a bottom surface of the casing, is made of metal in order to let heat generated in the assembly efficiently escape to the outside. It is also disclosed that the reactor of JP 2011-243943A 1 is provided with a heat dissipating layer on the installation surface portion (mounting plate) of the casing in order to let heat easily escape from the assembly to the casing.

The heat dissipating layer can be made of a ceramic sintering plate, an epoxy adhesive, or the like. In particular, the heat dissipating layer made of an adhesive such as a resin, or the like allows the assembly to be firmly fixed to the installation surface portion (mounting plate), and improves the adhesiveness between the coil of the assembly and the heat dissipating layer, making it possible to let heat in the assembly efficiently escape to the installation surface portion of the casing.

If the heat dissipating layer is made of an adhesive such as a resin, or the like, that is, when the heat dissipating layer is used as a bonding layer for bonding the assembly and the mounting plate, there are the following problems.

The assembly is very heavy because both the coil and the magnetic core that constitute the assembly are mainly made of metal. Accordingly, if the heavy assembly is placed on the bonding layer of the mounting plate when the bonding layer is uncured, there is a risk that the assembly may sink into the uncured bonding layer, and the coil of the assembly may come into contact with the mounting plate. In order to avoid the contact, it is necessary to hold the assembly until the bonding layer is cured.

The present invention was made in view of the above-described circumstances, and it is an object thereof to provide a reactor that can be manufactured without holding an assembly when the assembly is fixed to a mounting plate via a bonding layer.

SUMMARY OF INVENTION

According to one aspect of the present invention, a reactor includes: a coil that has a wound portion; a magnetic core, a part of which is arranged inside the wound portion; an interposed insulating member that ensures insulation between the coil and the magnetic core; a mounting plate that is made of metal, and on which an assembly obtained by assembling the coil, the magnetic core, and the interposed insulating member is mounted; and a bonding layer that fixes the assembly to the mounting plate. The interposed insulating member is provided with: an inwardly interposed portion that is interposed between an inner surface of the wound portion and the magnetic core; a first interposed end face portion that is interposed between one end face, in an axial direction, of the wound portion and the magnetic core; and a second interposed end face portion that is interposed between the other end face, in the axial direction, of the wound portion and the magnetic core. In this reactor, the interposed insulating member is obtained by combining a plurality of divided pieces that include a divided piece having the first interposed end face portion, and a divided piece having the second interposed end face portion, the divided pieces are respectively provided with engaging portions that engage with each other, and the first interposed end face portion and the second interposed end face portion are each provided with a leg piece that separates the coil from the mounting plate.

The above-described reactor can be manufactured without holding an assembly when the assembly is fixed to a mounting plate via a bonding layer.

DETAILED DESCRIPTION OF THE PREFERRED EMBODIMENTS

Figure 1:
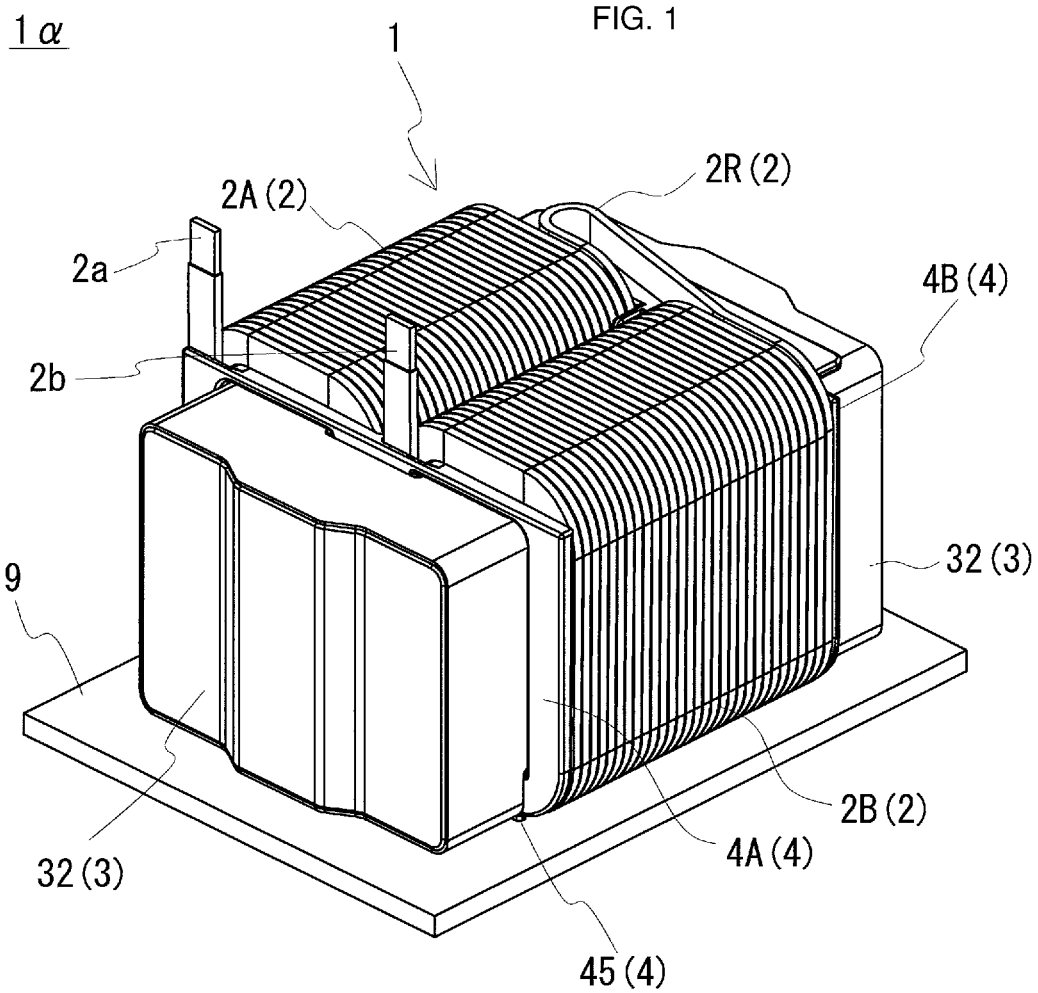
FIG. 1 is a perspective view from above illustrating a reactor of Embodiment 1.

First, embodiments of the present invention will be described in order.

<1> The reactor according to one embodiment includes: a coil that has a wound portion; a magnetic core, a part of which is arranged inside the wound portion; an interposed insulating member that ensures insulation between the coil and the magnetic core; a mounting plate that is made of metal, and on which an assembly obtained by assembling the coil, the magnetic core, and the interposed insulating member is mounted; and a bonding layer that fixes the assembly to the mounting plate. The interposed insulating member is provided with: an inwardly interposed portion that is interposed between an inner surface of the wound portion and the magnetic core; a first interposed end face portion that is interposed between one end face, in an axial direction, of the wound portion and the magnetic core; and a second interposed end face portion that is interposed between the other end face, in the axial direction, of the wound portion and the magnetic core. In this reactor, the interposed insulating member is obtained by combining a plurality of divided pieces that include a divided piece having the first interposed end face portion, and a divided piece having the second interposed end face portion, the divided pieces are respectively provided with engaging portions that engage with each other, and the first interposed end face portion and the second interposed end face portion are each provided with a leg piece that separates the coil from the mounting plate.

According to the above-described reactor, it is possible to manufacture the reactor without holding the assembly when the assembly is fixed to the mounting plate via the bonding layer. This is because the interposed end face portions of the interposed insulating member are provided with the leg pieces. Also the feature that the divided pieces are respectively provided with the engaging portions via which the divided pieces engage with each other serves as one of factors for making it possible to manufacture the reactor without holding the assembly when the assembly is fixed to the mounting plate via the bonding layer. The assembly is configured so as to be able to be independent as a result of the divided pieces engaging with each other via the engaging portions thereof, and thus the mounting plate and the coil of the assembly are kept as being separated from each other without the assembly mounted on the mounting plate being disengaged.

<2> In the reactor according to one embodiment, the leg pieces may be embedded in the bonding layer.

As a result of the leg pieces being embedded in the bonding layer, the fixation between the assembly and the mounting plate can be made strong. This is because the leg pieces embedded in the bonding layer function as an anchor. A barb may also be formed at the front ends of the leg piece to improve the function of the anchor of the leg pieces.

<3> In the reactor according to one embodiment, the reactor may further include a casing in which the assembly is housed; and a potting resin with which the casing is filled, wherein a bottom portion of the casing serves also as the mounting plate.

As a result of the casing and the potting resin being provided, the constituent components of the assembly can reliably be protected from the external environment. By using a material superior in thermal conductivity as the material of the casing and the potting resin, it is also possible to improve the heat dissipation of the reactor. Furthermore, in this configuration, the potting resin is provided in a gap between the coil and the mounting plate that are separated from each other by the leg pieces. The potting resin provided at this position has the function of achieving more reliable insulation between the coil and the mounting plate.

<4> In the reactor according to one embodiment, at least one of the first interposed end face portion and the second interposed end face portion may be provided with a plurality of leg pieces that are arranged at positions located at a distance from each other.

The leg pieces formed at positions located at a distance from each other allow, when the assembly is mounted on the mounting plate with an uncured bonding layer, the excessive uncured bonding layer to escape from a space between the leg pieces located at a distance from each other. As a result, it is possible to prevent a situation in which the assembly is inclined on the mounting plate due to the excessive bonding layer.

<5> In the reactor according to one embodiment, the interposed insulating member may be obtained by combining a first divided piece including the first interposed end face portion, and a second divided piece that is constituted by a portion of the interposed insulating member other than the first divided piece.

As a result of the interposed insulating member being divided into two parts, it is possible to achieve a reactor whose assembly is easy, and that is superior in productivity.

<6> In the reactor according to one embodiment, in which the interposed insulating member is divided into two parts, the coil may include a pair of wound portions that are arranged in parallel, and the interposed insulating member may be obtained by combining: a U-shaped first divided piece that is constituted by the first interposed end face portion and a pair of inwardly interposed portions that respectively correspond to the pair of wound portions; and a plate-shaped second divided piece that is constituted by the second interposed end face portion, and is combined with the U-shaped first divided piece.

With the configuration in which the U-shaped first divided piece and the plate-shaped second divided piece are combined with each other, it is possible to easily manufacture the assembly.

<7> In the reactor according to one embodiment, in which the interposed insulating member is divided into two parts, the coil may include a pair of wound portions that are arranged in parallel; and the interposed insulating member may be obtained by combining: an L-shaped first divided piece that is constituted by the first interposed end face portion and an inwardly interposed portion that corresponds to one of the wound portions; and an L-shaped second divided piece that is constituted by the second interposed end face portion and an inwardly interposed portion that corresponds to the other one of the wound portions, the L-shaped second divided piece being combined with the L-shaped first divided piece.

With the configuration in which the L-shaped first divided piece and the L-shaped second divided piece are combined with each other, it is possible to easily manufacture the assembly. Particularly, in this configuration, the first divided piece and the second divided piece may also have the same shape, and in this case, it is possible to use one type of mold for manufacturing the divided pieces.

Hereinafter, embodiments of the reactor according to the present invention will be described with reference to the drawings. The same reference signs in the drawings indicate the same components. Note that the present invention is defined by the claims without being limited to configurations shown in the embodiments, and all modifications in the meaning and scope that are equivalent to the claims are intended to be included.

Embodiment 1

Overall Configuration

Figure 2:
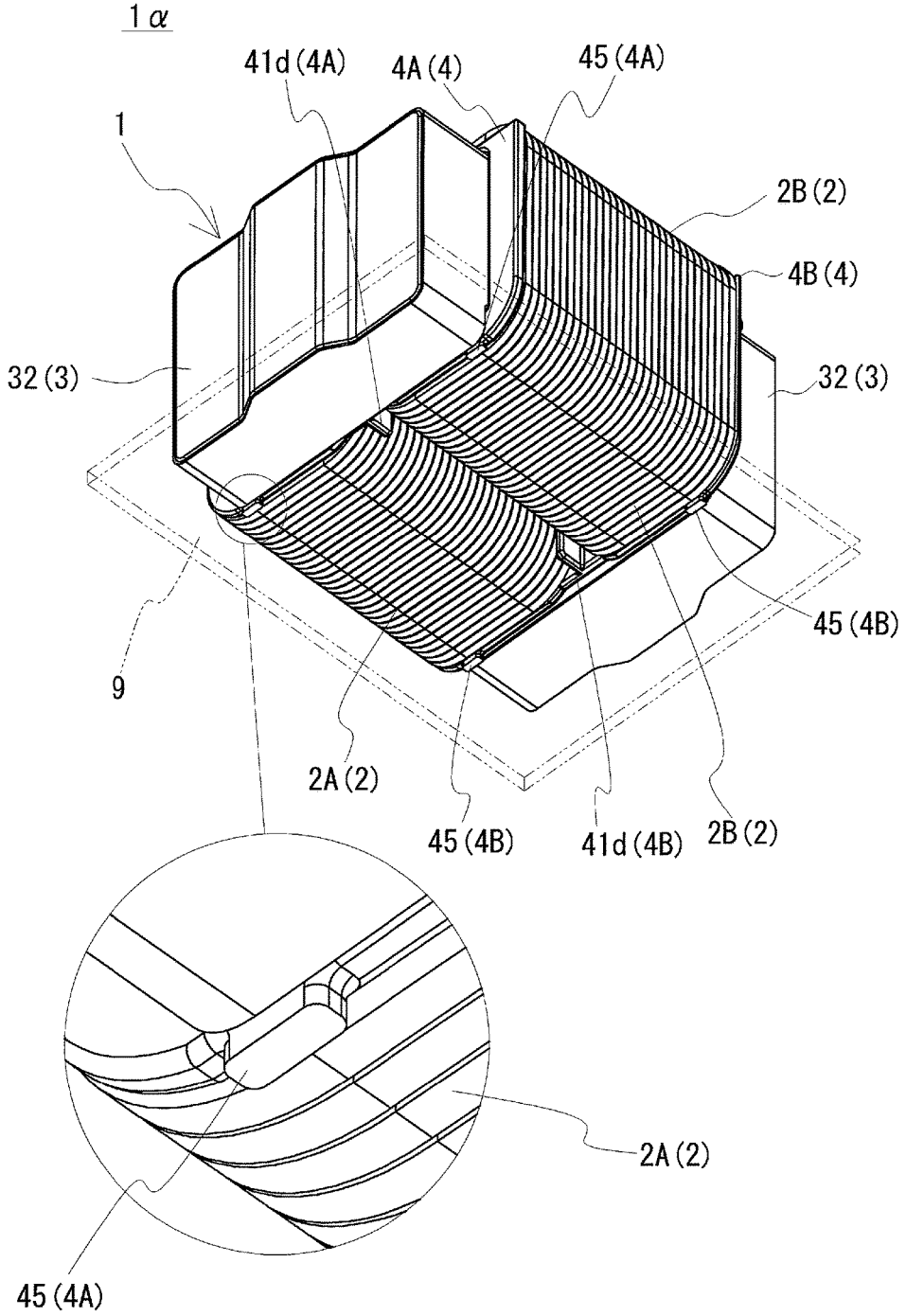
FIG. 2 is a perspective view from below illustrating the reactor of Embodiment 1.
Figure 3:
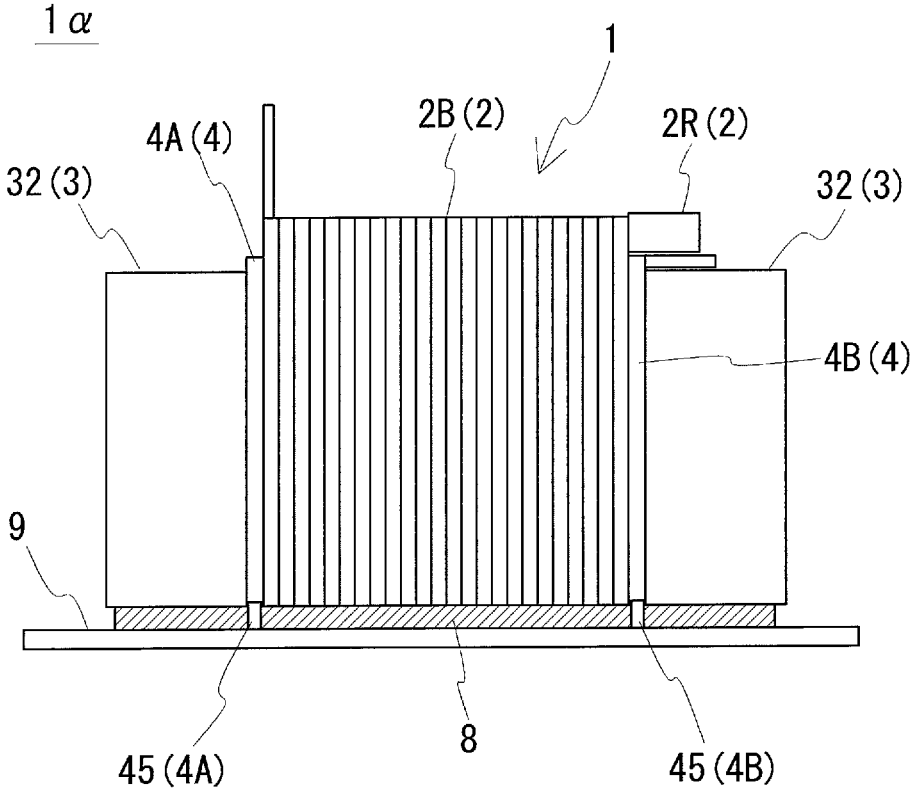
FIG. 3 is a schematic side view illustrating the reactor of Embodiment 1.
Figure 4:
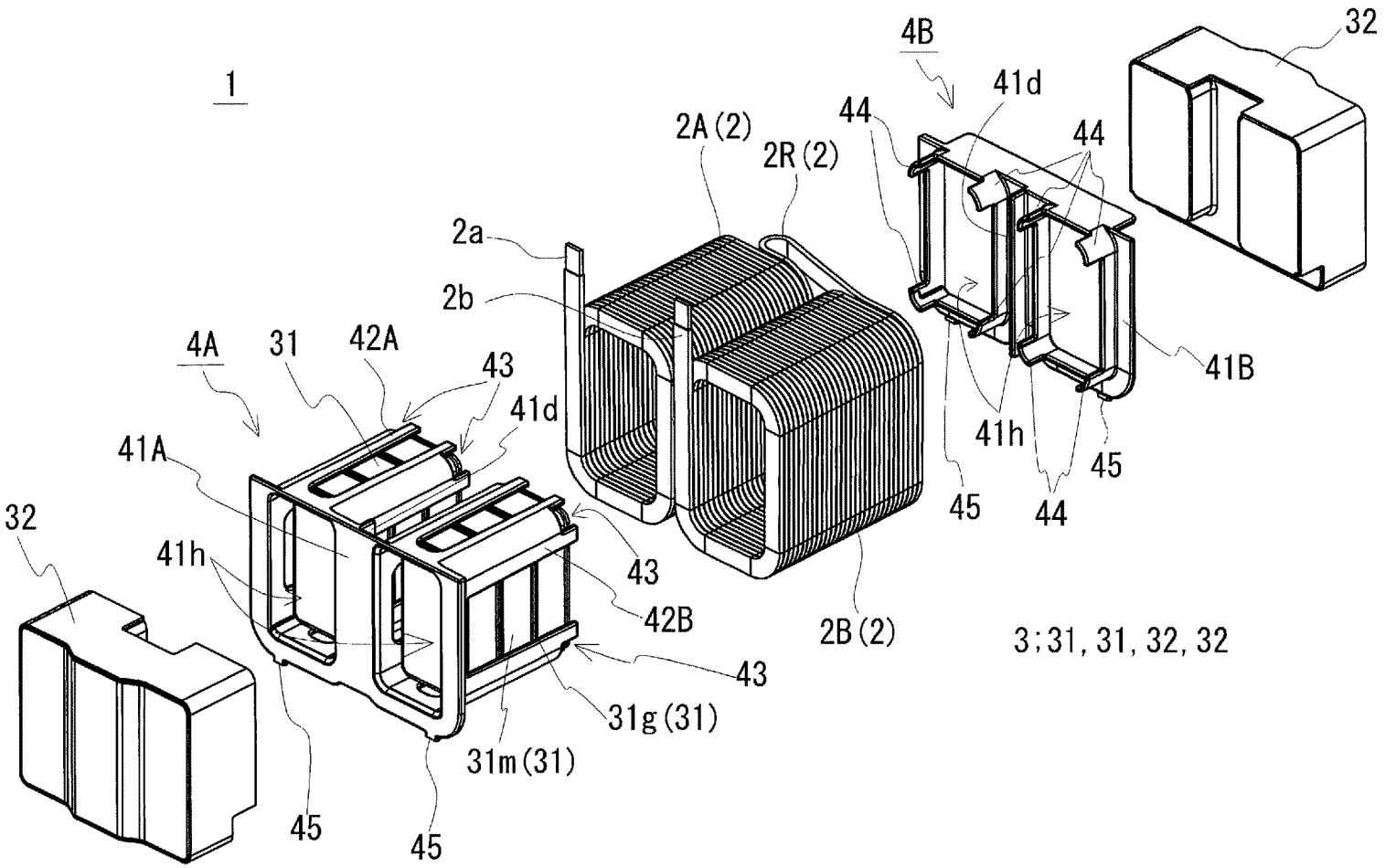
FIG. 4 is an exploded perspective view illustrating an assembly provided in the reactor of Embodiment 1.
Figure 5:
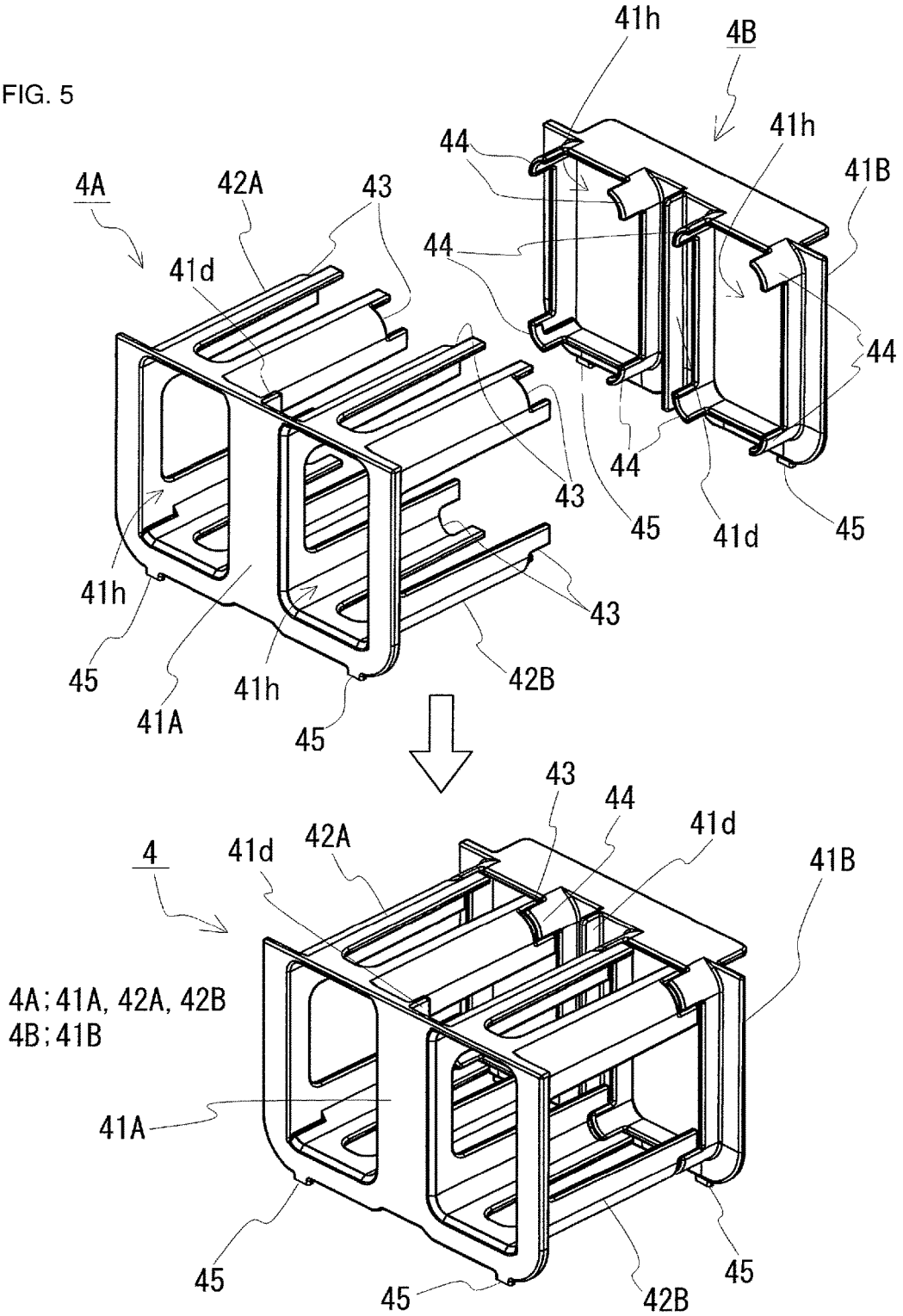
FIG. 5 is a perspective view illustrating an interposed insulating member provided in the reactor of Embodiment 1.

A reactor 1α of Embodiment 1 will be described with reference to FIGS. 1 to 5. FIG. 1 is a perspective view from above showing the reactor 1α, FIG. 2 is a perspective view from below showing the reactor 1α, FIG. 3 is a schematic side view showing the reactor 1α, FIG. 4 is an exploded perspective view showing an assembly 1 provided in the reactor 1α, and FIG. 5 is a perspective view showing an interposed insulating member 4, which is one of constituent components of the assembly 1. Here, in FIG. 3, constituent components of the reactor 1α are simplified, and leg pieces 45, which are a part of the interposed insulating member 4, are shown to be larger than they are in reality.

The reactor 1α of the present embodiment that is shown in FIGS. 1 to 3 has a configuration in which the assembly 1 obtained by assembling a coil 2, a magnetic core 3, and the interposed insulating member 4 is mounted on a mounting plate 9, as with a conventional reactor. As shown in FIG. 3, a bonding layer 8 for bonding the assembly 1 and the mounting plate 9 is formed between the assembly 1 and the mounting plate 9 (the bonding layer is omitted in FIGS. 1 and 2). The reactor 1α of the present embodiment differs from conventional reactors mainly in that, as shown in FIG. 3, the coil 2 of the assembly 1 is separated from the mounting plate 9 by the interposed insulating member 4. The following will describe the constituent components of the reactor 1α in detail.

Assembly

The assembly 1 is described mainly with reference to the exploded perspective view of FIG. 4. The assembly 1 is obtained by mechanically assembling the coil 2, the magnetic core 3, and the interposed insulating member 4.

Coil

The coil 2 of the present embodiment is provided with a pair of wound portions 2A and 2B, and a coupling portion 2R that couples the two wound portions 2A and 2B to each other. The wound portions 2A and 2B are formed in the shape of hollow tubes by being wound in the same direction with the same number of turns, and are arranged in parallel such that their axial directions are in parallel to each other. Furthermore, the coupling portion 2R is a portion that is bent in the U shape to couple the two wound portions 2A and 2B to each other. The coil 2 may be formed by spirally winding one coil wire without a joint, or may be formed by winding different coil wires for the wound portions 2A and 2B, and joining end portions of the coil wires of the wound portions 2A and 2B with each other using welding, crimping, or the like.

The wound portions 2A and 2B of the present embodiment are square tubular. "Square tubular wound portions 2A and 2B" refer to wound portions whose end faces have the shape of a quadrangle (which may also be a square) having rounded corners. The wound portions 2A and 2B may, of course, be cylindrical. "Cylindrical wound portions" refer to wound portions whose end faces have the shape of a closed surface (such as an oval, a true circle, or a race track shape).

The coil 2 including the wound portions 2A and 2B can be constituted by a coated wire in which an electric conductor, such as a rectangular wire or a round wire, that is made of an electric conducting material such as copper, aluminum, magnesium, or alloys thereof is provided with, on its outer circumference, an insulating coating made of an insulating material. In the present embodiment, the wound portions 2A and 2B are formed by winding a rectangular coated wire in which an electric conductor is made of a rectangular copper wire, and an insulating coating is made of enamel (typically, polyamide-imide) edgewise.

Both end portions 2*a* and 2*b* of the coil 2 extend from the wound portions 2A and 2B, and are connected to not-shown terminal members. An external device such as a power supply for supplying the coil 2 with power is connected via the terminal members.

Magnetic Core

The magnetic core 3 of the present embodiment is obtained by combining a pair of inner core members 31 and a pair of outer core members 32.

Inner Core Member

The inner core members 31 are each a substantially cuboid-shaped core piece that is arranged inside the wound portion 2A (2B) of the coil 2 while being housed in an inwardly interposed portion 42A (42B) of the interposed insulating member 4, which will be described later. The inner core members 31 have an axial length that is shorter than the axial length of the wound portion 2A (2B).

The inner core members 31 are stacked columns in which substantially cuboid-shaped core pieces 31*m* including a magnetic material and gap members 31*g* having a lower magnetic permeability than the core pieces 31*m* are alternately coupled to each other. The gap members 31*g* are arranged at both ends of the stacked columns. Alternatively, the inner core member 31 may be configured by a single columnar core piece. The core piece 31*m* constituting such an inner core member 31 may employ: a powder compacted molded body made of soft magnetic powder represented by iron group metal such as iron, alloys thereof (such as a Fe—Si alloy or a Fe—Ni alloy), or the like; a composite material constituted by a resin including the soft magnetic powder; a stacked body in which a plurality of magnetic thin plates (for example, magnetic steel plates) with an insulating coating are stacked; or the like. Furthermore, the gap members 31*g* may employ a non-magnetic material such as alumina. Alternatively, the gap members 31*g* may also employ a resin that constitutes the interposed insulating member 4, which will be described later.

Outer Core Member

The outer core members 32 are each a substantially U-shaped core piece. A part of the outer core members 32 (bifurcated front end part of the U shape) is arranged inside the inwardly interposed portions 42A and 42B of the interposed insulating member 4, that is, inside the wound portions 2A and 2B of the coil 2, and the other parts of the outer core members 32 are not covered with the wound portions 2A and 2B, and are arranged protruding from the wound portions 2A and 2B. A rear end (opposite to the bifurcated front end part) of the U-shaped portion of each outer core member 32 that is exposed from the wound portions 2A and 2B protrudes, at the center position in a direction in which the wound portions 2A and 2B are parallel to each other, further than other parts. As a result, the center part and the bifurcated front end part have the same thickness (the magnetic path has a uniform cross-sectional area). Furthermore, the portions of the outer core members 32 that are exposed from the wound portions 2A and 2B protrude to the side on which the mounting plate 9 (see FIGS. 1 and 2) is arranged, and the surfaces, on the mounting plate 9 side, of the protruding portions are co-planar with the surfaces, on the mounting plate 9 side, of the wound portions 2A and 2B of the coil 2. Note that, as shown in FIG. 3, the surfaces, on the mounting plate 9 side, of the protruding portions are located higher than the leg pieces 45 of the interposed insulating member 4, which will be described later, when seen from the mounting plate 9 side.

The above-described outer core members 32 can be configured by a powder compacted molded body, a composite material, a stacked body of magnetic thin plates, or the like, as with the core pieces 31*m* of the inner core members 31. The outer core members 32 and the core pieces 31*m* may have the same configuration, or may have different configurations. As an example of the latter, the inner core members 31 are made of a powder compacted molded body, and the outer core members 32 are made of a composite material.

Interposed Insulating Member

The interposed insulating member 4 is described mainly with reference to FIG. 5 (if necessary, FIGS. 1 to 4 as well). The interposed insulating member 4 shown in the lower part of FIG. 5 is provided with the pair of inwardly interposed portions 42A and 42B, a first interposed end face portion 41A, and a second interposed end face portion 41B, and plays a role of ensuring insulation between the coil 2 and the magnetic core 3 as shown in FIG. 4. The inwardly interposed portion 42A (42B) is interposed between the inner surface of the wound portion 2A (2B) and that portion of the magnetic core 3 that is arranged inside the wound portion 2A (2B). As shown in FIG. 4, the first interposed end face portion 41A is interposed between one end faces, in the axial direction, of the wound portions 2A and 2B, and that portion of the magnetic core 3 that is exposed from the wound portions 2A and 2B. Furthermore, the second interposed end face portion 41B is interposed between the other end faces, in the axial direction, of the wound portions 2A and 2B, and that portion of the magnetic core 3 that is exposed from the wound portions 2A and 2B.

The interposed insulating member 4 of the present embodiment is configured by combining a first divided piece 4A and a second divided piece 4B that are shown in the upper part of FIG. 5. The interposed insulating member 4 obtained by combining the two divided pieces 4A and 4B plays, in addition to the above-described role of ensuring insulation, a role of keeping the coil 2 of the assembly 1 separate from the mounting plate 9, to be exact, a role of keeping the wound portion 2A (2B) of the coil 2 separate from the mounting plate 9, as shown in FIG. 3.

First Divided Piece

As shown in the upper part of FIG. 5, the first divided piece 4A has a configuration in which the first interposed end face portion 41A and the pair of inwardly interposed portions 42A and 42B are formed as one piece.

The first interposed end face portion 41A has a pair of insertion holes 41*h* for guiding the inner core members 31 (see FIG. 4) and the U-shaped end part of the outer core member 32 to the inwardly interposed portions 42A and 42B. Furthermore, a partition portion 41*d* is formed on that surface of the first interposed end face portion 41A on which the inwardly interposed portions 42A and 42B are provided. The partition portion 41*d* is interposed between the wound portions 2A and 2B when the interposed insulating member 4 is combined with the coil 2, and keeps both of the wound portions 2A and 2B separate from each other (see also FIG. 2). Due to the separation, it is possible to reliably ensure insulation between the wound portions 2A and 2B.

Furthermore, the first interposed end face portion 41A is provided with, on its lower end face (end face on the side on which the mounting plate 9 shown in FIG. 3 is provided), a pair of leg pieces 45. The leg pieces 45 are respectively provided on the left and right sides, in the width direction, of the first interposed end face portion 41A. As shown in FIG. 3 and the circular enlarged view in FIG. 2, the leg pieces 45 protrude further than the surfaces, on the mounting plate 9 side, of the wound portions 2A and 2B of the coil 2 when the interposed insulating member 4 is attached to the coil 2. Accordingly, as shown in FIG. 3, when the assembly 1 is mounted on the mounting plate 9, the leg pieces 45 abut against the mounting plate 9, and the wound portions 2A and 2B are separated from the mounting plate 9.

On the other hand, as shown in FIG. 4, the inwardly interposed portion 42A (42B) of the first divided piece 4A is constituted by four supporting members that support the corners of the peripheral surface of the inner core member 31. Each supporting member has a substantially arc-shaped cross section, so as to make it easy to support the corner of the peripheral surface of the inner core member 31. Note here that the inwardly interposed portion 42A (42B) is not limited to the shown configuration in which it is constituted by the four supporting members, but may be formed to be tubular.

The supporting members constituting the inwardly interposed portion 42A (42B) are each provided with, as shown in FIG. 5, an engaging portion 43 for mechanically engaging the first divided piece 4A with the second divided piece 4B that will be described later. The engaging portion 43 is provided at the end of the supporting member that is opposite to the first interposed end face portion 41A. The engaging portion 43 of this example is formed by cutting the end of the supporting member in the shape of a recess.

Second Divided Piece

The second divided piece 4B is constituted by the second interposed end face portion 41B of the interposed insulating member 4. Similar to the first divided piece 4A, the second divided piece 4B has: a pair of insertion holes 41*h* that are arranged in parallel; a partition portion 41*d*; and a pair of leg pieces 45.

The second divided piece 4B is further provided with projecting engaging portions 44 that correspond to the recess-shaped engaging portions 43 of the first divided piece 4A. The projecting engaging portions 44 are respectively provided at the four corners of each insertion hole 41*h*, that is, eight projecting engaging portions 44 in total are provided on the second divided piece 4B. As shown in the lower part of the FIG. 5, by fitting the projecting engaging portions 44 of the second divided piece 4B into the above-described recess-shaped engaging portions 43 of the first divided piece 4A, it is possible to manufacture the interposed insulating member 4 in which the divided pieces 4A and 4B are mechanically coupled to each other.

Constituent Material of Interposed Insulating Member

The constituent material of the above-described interposed insulating member 4 (the first divided piece 4A and the second divided piece 4B) may be, for example, a thermoplastic resin such as a polyphenylenesulfide (PPS) resin, a polytetrafluoroethylene (PTFE) resin, a polyamide (PA) resin such as liquid-crystal polymer (LCP), nylon 6, or nylon 66, a polybutyleneterephthalate (PBT) resin, or an acrylonitrile-butadiene-styrene (ABS) resin. Alternatively, a thermosetting resin such as an unsaturated polyester resin, an epoxy resin, a urethane resin, or a silicone resin may be used. A ceramic filler may also be added to the above-described resin to improve the thermal conductivity of the interposed insulating member 4. For example, nonmagnetic powder such as alumina or silica may be used as the ceramic filler.

Mounting Plate

As shown in FIG. 3, the mounting plate 9 is a member that functions as a base that is used when the reactor 1α is fixed to an installation destination such as a cooling base. Accordingly, the mounting plate 9 is required to be superior in mechanical strength. Furthermore, the mounting plate 9 is required to play a role of letting heat generated in the assembly 1 during the use of the reactor 1α escape to the installation destination. Therefore, the mounting plate 9 is required to be superior in not only mechanical strength but also heat dissipation. In order to meet such requirements, the mounting plate 9 is made of metal. For example, aluminum, alloys thereof, magnesium, or alloys thereof may be used as the constituent material of the mounting plate 9. Metal (alloy) materials are superior in mechanical strength and thermal conductivity, and have advantages in lightweight and nonmagnetic.

Bonding Layer

The bonding layer 8 is formed between the assembly 1 and the mounting plate 9, and has a function of bonding both of the components 1 and 9. Furthermore, the bonding layer 8 also has a function of conducting heat generated in the assembly 1 during the use of the reactor 1α to the mounting plate 9.

It is sufficient for the bonding layer 8 to have a size such that it corresponds to at least the lower surface (surfaces that face the mounting plate 9) of the coil 2 of the assembly 1. In this example, the bonding layer 8 has a size such that it substantially corresponds to the lower surface of the assembly 1, and the leg pieces 45 are embedded in the bonding layer 8.

The constituent material of the bonding layer 8 is assumed to be insulating. Examples of the constituent material of the bonding layer 8 include: a thermosetting resin such as an epoxy resin, a silicone resin, and an unsaturated polyester; and a thermoplastic resin such as a PPS resin and liquid-crystal polymer (LCP). The above-described ceramic filler or the like may also be added to the insulating resin to improve the heat dissipation of the bonding layer 8. The thermal conductivity of the bonding layer 8 is preferably 0.1 W/m·K or more, further preferably 1 W/m·K or more, and particularly preferably 2 W/m·K or more, for example.

The bonding layer 8 may be formed by applying an insulating resin (or a resin that contains a ceramic filler) to the mounting plate 9, or by attaching a sheet material of an insulating resin to the mounting plate 9. A sheet-like material is preferably used as the bonding layer 8 in order to achieve easy formation of the bonding layer 8 on the mounting plate 9.

Procedure for Manufacturing Reactor

The following will describe the procedure for manufacturing the reactor 1α having the above-described configuration.

Manufacturing of Assembly

First, as shown in FIG. 4, the coil 2, the inner core members 31, the outer core members 32, the first divided piece 4A, and the second divided piece 4B are prepared. Then, the inner core members 31 are inserted into the inwardly interposed portions 42A and 42B of the first divided piece 4A, and the inwardly interposed portions 42A and 42B are inserted into the wound portions 2A and 2B of the coil 2. Then, the projecting engaging portions 44 of the second divided piece 4B are engaged with the recess-shaped engaging portions 43 of the first divided piece 4A, and the divided pieces 4A and 4B are mechanically coupled to each other. The engaging portions 43 and 44 may be bonded to each other with an adhesive as needed.

Then, the U-shaped end parts of the outer core members 32 are inserted into the insertion holes 41*h* of the divided pieces 4A and 4B, and the assembly 1 is completed. At this time, the outer core members 32 and the inner core pieces 31 may be bonded to each other with an adhesive.

Mounting of Assembly on Mounting Plate

Then, as shown in FIG. 3, the bonding layer 8 is formed on the upper surface of the mounting plate 9, and the assembly 1 is placed on the bonding layer 8 before the bonding layer 8 is cured. At this time, the assembly 1 is mounted on the mounting plate 9 in a state in which the leg pieces 45 provided on the interposed insulating member 4 of the assembly 1 abut against the mounting plate 9 and the coil 2 of the assembly 1 is separated from the mounting plate 9.

Here, since the pair of leg pieces 45 provided on each of the divided pieces 4A and 4B of this example, as shown in FIG. 4, are located at a distance from each other in the width direction of the divided pieces 4A and 4B, a gap is formed between the pair of leg pieces 45. This gap also functions as a path in which an uncured resin constituting the bonding layer 8 escapes when the assembly 1 is mounted on the mounting plate 9, as shown in FIG. 3. Accordingly, even when there is a large amount of uncured resin on the mounting plate 9, a defect in which the assembly 1 is arranged on the mounting plate 9 while being inclined is unlikely to occur.

Lastly, the bonding layer 8 is cured, and the reactor 1α can be completed. Here, since, in this example, the mounting plate 9 and the wound portions 2A and 2B of the coil 2 are mechanically separated from each other by the leg pieces 45, it is not necessary to hold the assembly 1 until the bonding layer 8 is cured. Furthermore, because the separation distance between the mounting plate 9 and the wound portions 2A and 2B of the coil 2 depends on the projection amount of the leg pieces 45, it is possible to fix the insulation performance between the mounting plate 9 and the coil 2 to a predetermined value, preventing a variation in insulation performance among different lots.

Modification 1-1

There is no particular limitation to the number and positions of the leg pieces 45 as long as the assembly 1 can be stable on the mounting plate 9. Referring to FIG. 5, it is possible to take, as an example, a configuration in which the first divided piece 4A has two leg pieces 45, while the second divided piece 4B has one leg piece 45, that is, a configuration in which three leg pieces 45 support the assembly 1. In this case, by forming the leg piece 45 of the second divided piece 4B in the middle area, in the width direction, of the second divided piece 4B (direction in which the insertion holes 41*h* are arranged in parallel), it is possible to improve the stability of the assembly 1 on the mounting plate 9 (see FIGS. 1 to 3). For example, it is also possible to extend the partition portions 41*d* below the assembly 1, and to use the extended partition portions 41*d* as leg pieces. Note that it is also possible that the first divided piece 4A has one leg piece 45, while the second divided piece 4B has two leg pieces 45.

Furthermore, it is also possible that each of the first divided piece 4A and the second divided piece 4B has one leg piece 45. In this case, it is preferable that the leg pieces 45 have a large width (in the direction in which the insertion holes 41*h* are arranged in parallel), so that the stability of the assembly 1 on the mounting plate 9 (see FIGS. 1 to 3) is improved. Alternatively, it is also possible that each of the divided piece 4A and 4B has three leg pieces 45 or more.

Embodiment 2

In Embodiment 2, a reactor 1β in which the assembly 1 is housed in a casing 5 will be described with reference to FIG. 6. The configuration of the assembly 1 is the same as in Embodiment 1, and thus the detailed description of the assembly 1 is omitted.

Figure 6:
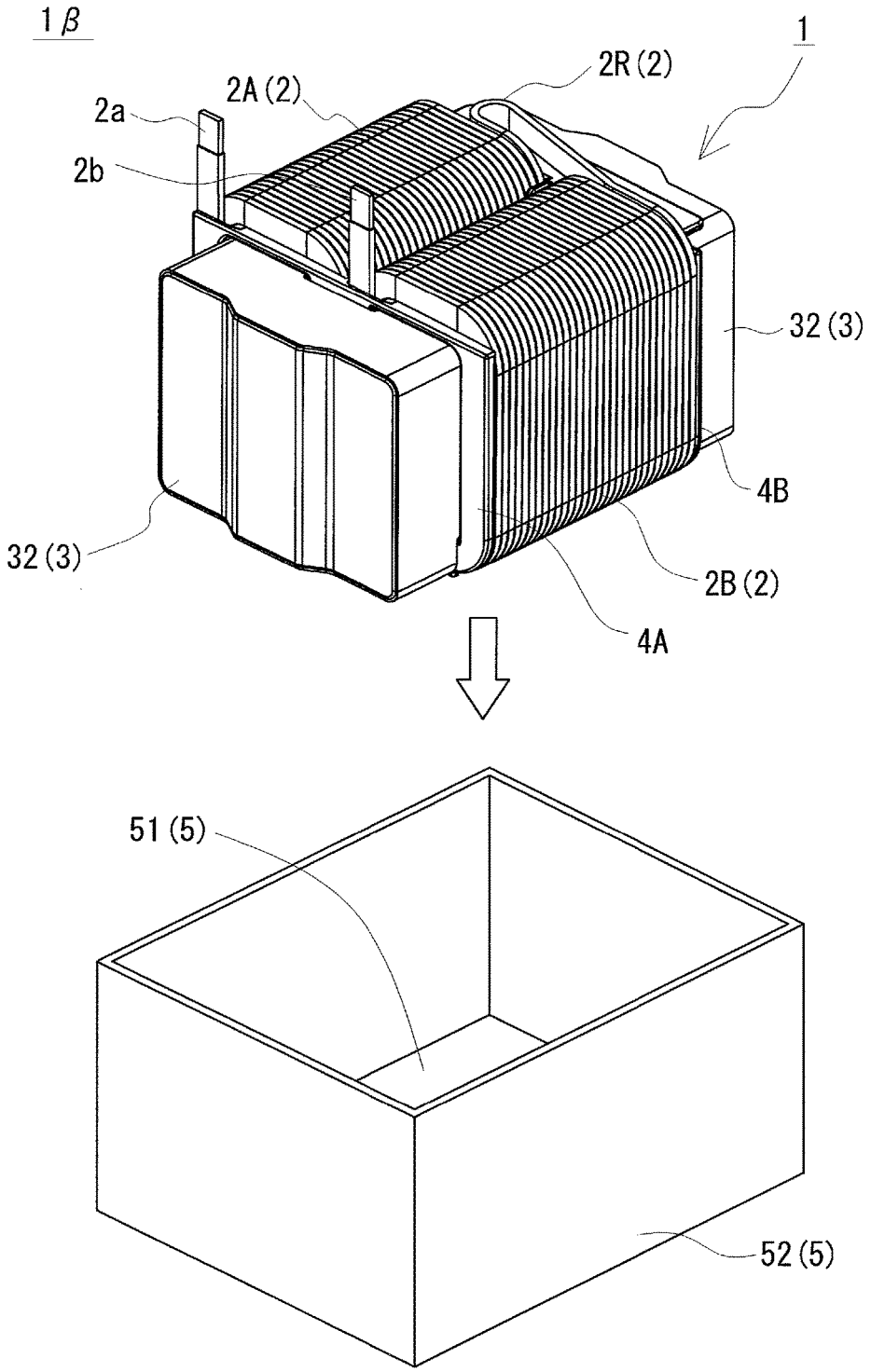
FIG. 6 illustrates a procedure in which the assembly is housed in a casing having the shape of a tube that is closed on one side.

The casing 5 shown in FIG. 6 is a member that has the shape of a tube that is closed on one side, and is provided with a bottom plate portion 51 and a side wall portion 52. The bottom plate portion 51 serves also as a mounting plate on which the assembly 1 is mounted. This casing 5 is filled with a not-shown potting resin, and the assembly 1 is embedded in the casing 5. The casing 5 may be provided with a fixation portion for fixing the reactor 1β to an installation destination such as a cooling base.

In order to manufacture the reactor 1β of Embodiment 2, a bonding layer (not shown) is formed on the bottom plate portion 51 of the casing 5, and then the assembly 1 is inserted via the upper-end opening of the casing 5 before the bonding layer is cured. When the assembly 1 is housed in the casing 5, the leg pieces 45 of the assembly 1 abut against the bottom plate portion 51, and the coil 2 of the assembly 1 is held in the state of being separated from the bottom plate portion 51.

After the assembly 1 is housed in the casing 5 and the bonding layer is cured, the not-shown potting resin is poured into the casing 5. At this time, the amount of the potting resin is adjusted so that the end portions 2*a* and 2*b* of the coil 2 of the assembly 1 are not covered with the potting resin. For example, an epoxy resin, a urethane resin, and a silicone resin can be used as the potting resin. Furthermore, a ceramic filler may also be added to such a resin to improve the heat dissipation of the potting resin.

Lastly, the potting resin is cured, and the reactor 1β is completed. In use of the reactor 1β, an external device is connected to the end portions 2*a* and 2*b* of the coil 2 that are exposed from the potting resin of the casing 5.

The reactor 1β that has been described so far can physically protect the assembly 1 from the external environment with the casing 5 and the potting resin. Furthermore, since the assembly 1 is firmly fixed to the inside of the casing 5 with the potting resin, it is possible to suppress vibration of the reactor 1β during the use thereof.

Modification 2-1

Figure 7:
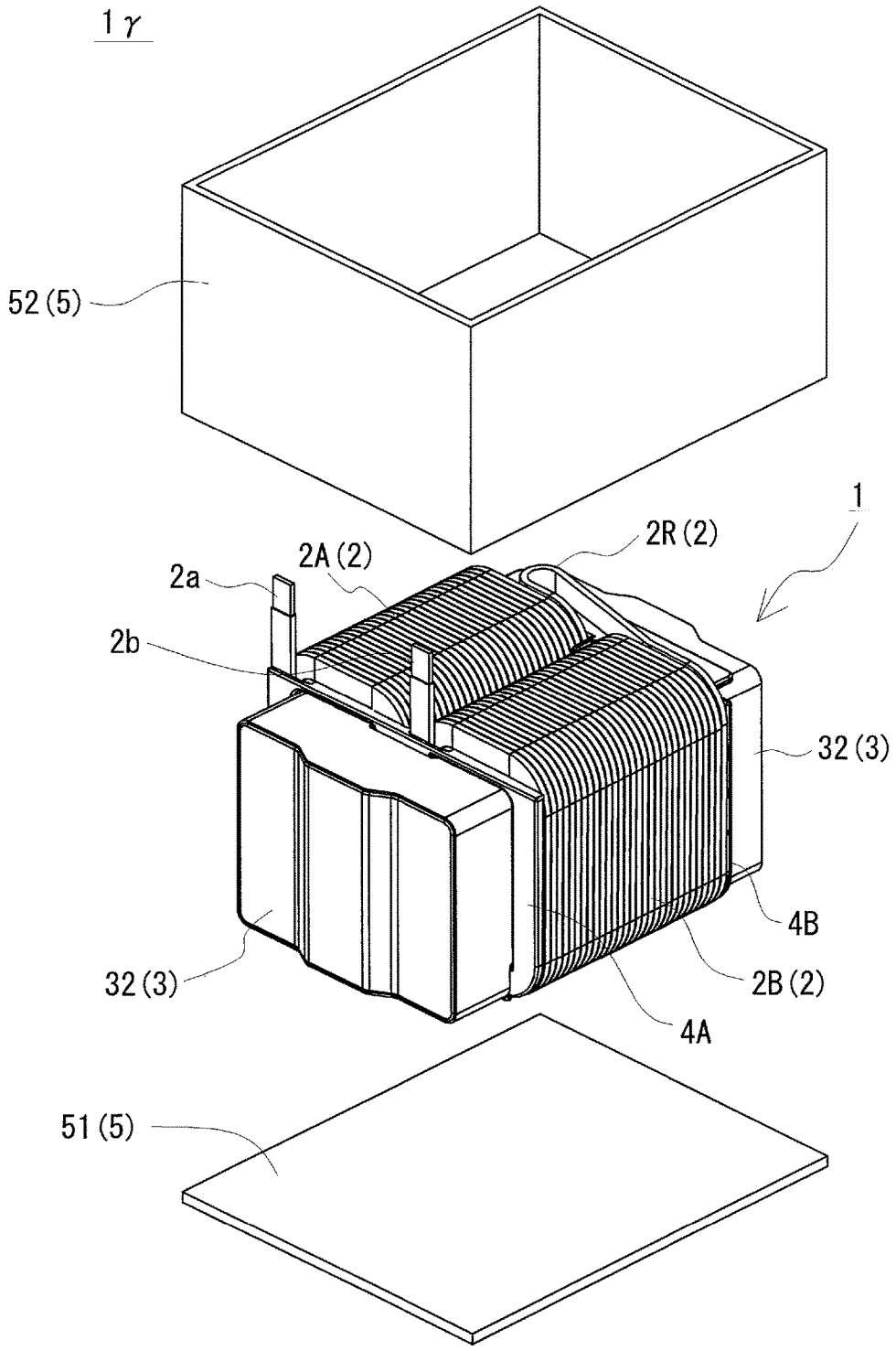
FIG. 7 illustrates a procedure in which the assembly is housed in a casing having a side wall portion and a bottom plate portion that are separate from each other.

In Modification 2, a reactor 1γ that is provided with a casing 5 obtained by combining a bottom plate portion 51 and a side wall portion 52 that are separately prepared will be described with reference to FIG. 7.

If the bottom plate portion 51 and the side wall portion 52 are separately prepared, it is possible to make the bottom plate portion 51 and the side wall portion 52 of different materials. For example, the bottom plate portion 51 can be made of metal (for example, aluminum, alloys thereof, or the like), and the side wall portion 52 can be made of resin. In this case, it is possible to realize a lightweight reactor 1γ including the casing 5.

In order to manufacture the reactor 1γ of Embodiment 3, a bonding layer (not shown) is formed on the bottom plate portion 51 of the casing 5, and then the assembly 1 is placed on the bonding layer before the bonding layer is cured. Then, the side wall portion 52 is overlaid on the upper side of the assembly 1, and the bottom plate portion 51 and the side wall portion 52 are bonded to each other. The side wall portion 52 may be overlaid at a timing before or after the bonding layer is cured. Furthermore, the bottom plate portion 51 and the side wall portion 52 may be bonded to each other with an adhesive, or may be coupled to each other with mechanical means such as screws.

After the casing 5 is completed, a potting resin is poured into the casing 5, and the reactor 1γ is completed. When pouring the potting resin into the casing 5, one should check whether or not the bonding layer is fully cured.

According to the reactor 1γ that has been described so far, it is easy to arrange the assembly 1 at a predetermined position in the casing 5. This is because there is no side wall portion 52 on the bottom plate portion 51 when the assembly 1 is arranged on the bottom plate portion 51 (mounting plate).

Modification 2-2

Alternatively, it is also possible to use a converter casing as a casing for housing the assembly. Also in use of the converter casing, the bonding layer is formed at a position on a bottom plate portion (mounting plate) of the converter casing at which the assembly 1 is to be mounted, and the assembly is placed on the bonding layer before the bonding layer is cured.

Embodiment 3

Figure 8:
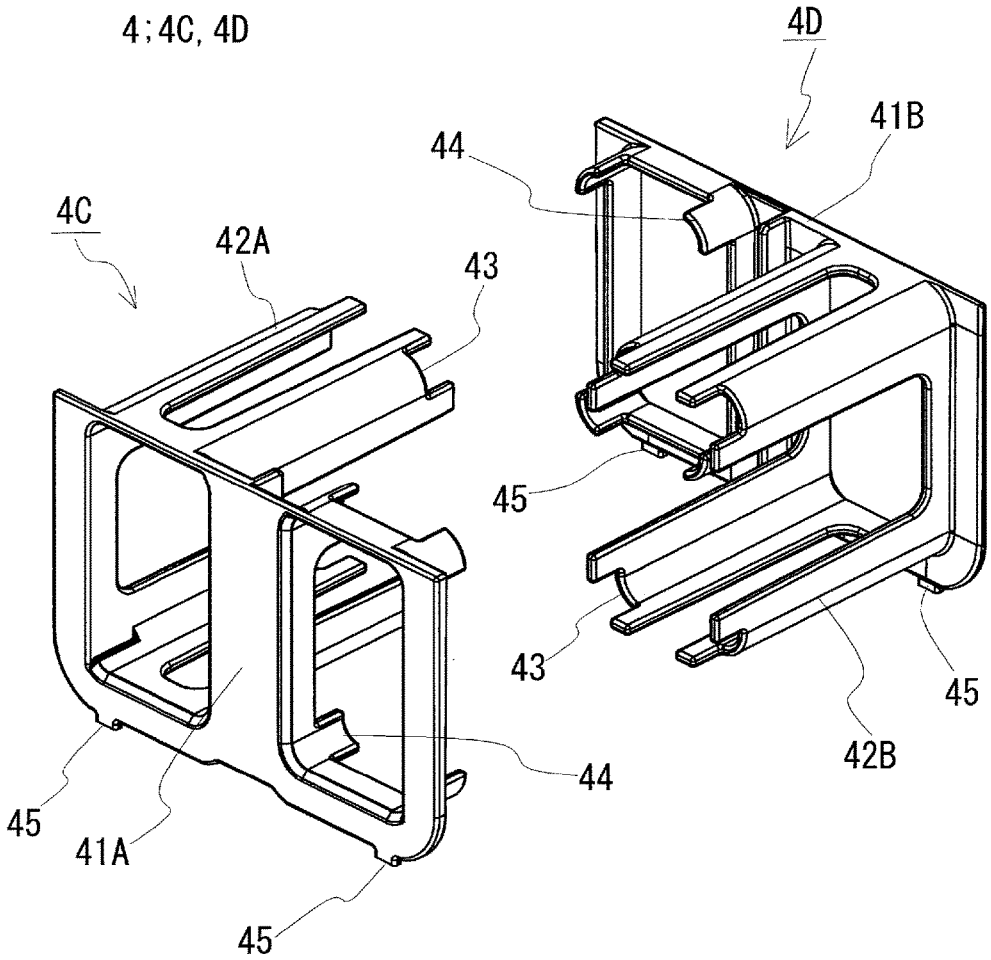
FIG. 8 is a schematic perspective view illustrating an interposed insulating member according to Embodiment 3.

In Embodiment 3, an interposed insulating member 4 that is constituted by a first divided piece 4C and a second divided piece 4D that are divided differently from Embodiment 1 will be described with reference to FIG. 8.

The first divided piece 4C (second divided piece 4D) is provided with a first interposed end face portion 41A (second interposed end face portion 41B) and an inwardly interposed portion 42A (inwardly interposed portion 42B). The second divided piece 4D is obtained by rotating the first divided piece 4C by 180° in the horizontal direction. In other words, the first divided piece 4C and the second divided piece 4D have the same shape.

Since the divided pieces 4C and 4D of Embodiment 3 have the same shape, it is possible to manufacture them using one type of mold. Accordingly, a reactor provided with the interposed insulating member 4 of Embodiment 3 is superior in productivity.

Embodiment 4

Figure 9:
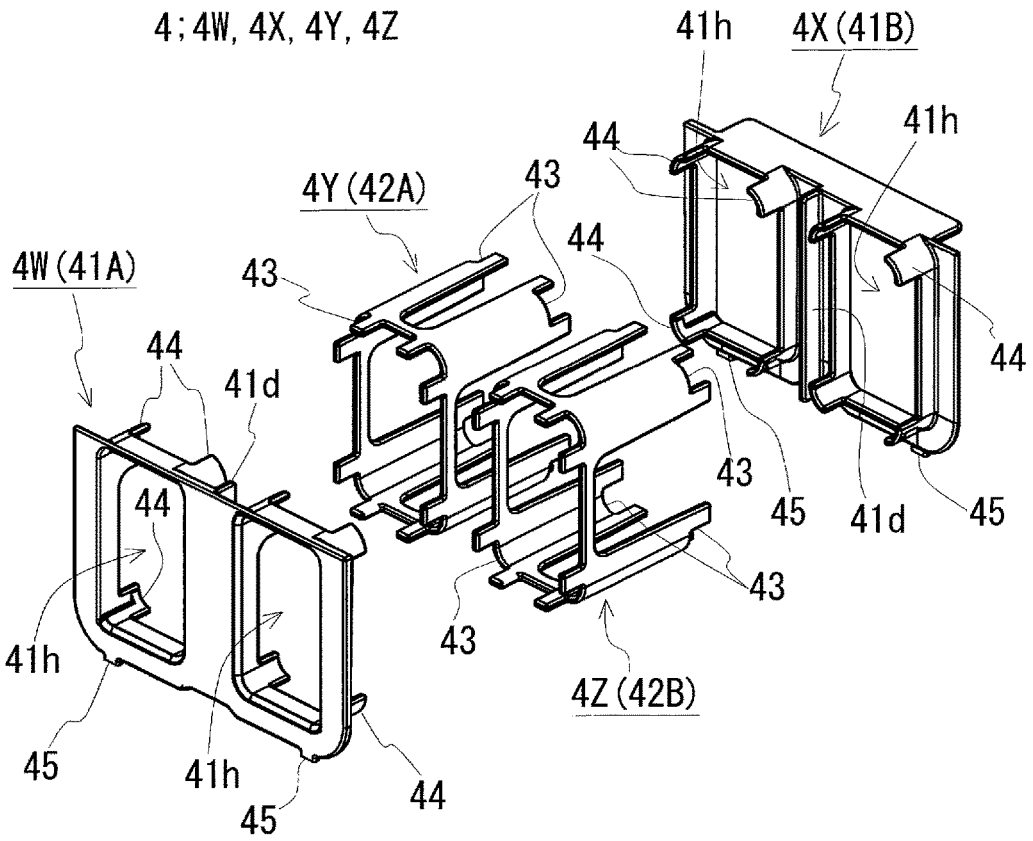
FIG. 9 is a schematic perspective view illustrating an interposed insulating member according to Embodiment 4.

Although the above-described embodiments have described two examples in which the interposed insulating member 4 is divided into two parts, the interposed insulating member 4 may be divided into three or more. In the present embodiment, an example in which an interposed insulating member 4 is divided into four parts will be described with reference to FIG. 9.

When the interposed insulating member 4 is divided into four parts, it is preferable to form the interposed insulating member 4 by combining a divided piece 4W constituted by a first interposed end face portion 41A, a divided piece 4X constituted by a second interposed end face portion 41B, a divided piece 4Y constituted by an inwardly interposed portion 42A, and a divided piece 4Z constituted by an inwardly interposed portion 42B.

In the above-described configuration, each of the divided pieces 4Y and 4Z is provided with, at its end on the divided piece 4W side, four recess-shaped engaging portions 43, and the divided piece 4W is provided with, on its surface on the divided piece 4Y (4Z) side, eight projecting engaging portions 44 that correspond to the engaging portions 43 of the divided pieces 4Y and 4Z. Each of the divided pieces 4Y and 4Z is further provided with, at its end on the divided piece 4X side, four recess-shaped engaging portions 43, and the divided piece 4X is provided with, on its surface on the divided piece 4Y (4Z) side, eight projecting engaging portions 44 that correspond to the engaging portions 43 of the divided pieces 4Y and 4Z. As a result, the interposed insulating member 4 that is obtained by combining the divided pieces 4W, 4X, 4Y, and 4Z is prevented from being disengaged.

The reactors according to the above-described embodiments can be used appropriately under the energization conditions of, for example, a maximum current (direct current) of about 100 A to 1000 A, an average voltage of about 100V to 1000V, and a rated frequency of about 5 kHz to 100 kHz, representatively, for constituent components of in-car electric power conversion devices of electric cars, hybrid cars, and the like. In such usages, reactors in which the inductance when a direct current of OA flows is between 10 pH and 2 mH inclusive, and the inductance when a maximum current flows is not greater than 10% of the inductance when a direct current of OA flows are expected to be appropriately used.

INDUSTRIAL APPLICABILITY

The reactors of the present invention are applicable to constituent components of an electric power conversion device such as bi-directional DC-DC converter that is installed in electric-powered vehicles such as hybrid cars, electric cars, and fuel-cell cars.

The invention claimed is:

1. A reactor comprising:

a coil that has a wound portion;

a magnetic core, a part of which is arranged inside the wound portion;

an interposed insulating member that ensures insulation between the coil and the magnetic core;

a mounting plate that is made of metal, and on which an assembly obtained by assembling the coil, the magnetic core, and the interposed insulating member is mounted; and a bonding layer that fixes the assembly to the mounting plate, the interposed insulating member being provided with: an inwardly interposed portion that is interposed between an inner surface of the wound portion and the magnetic core; a first interposed end face portion that is interposed between one end face, in an axial direction, of the wound portion and the magnetic core; and a second interposed end face portion that is interposed between the other end face, in the axial direction, of the wound portion and the magnetic core, wherein the interposed insulating member is obtained by combining a plurality of divided pieces that include a first divided piece having the first interposed end face portion, and a second divided piece having the second interposed end face portion, the divided pieces are respectively provided with engaging portions that engage with each other, the first interposed end face portion and the second interposed end face portion are each provided with a leg piece that separates the coil from the mounting plate, and the leg piece provided on the first interposed end face portion has a thickness such that the leg piece does not protrude from the first interposed end face portion in a thickness direction of the first interposed end face portion, and the leg piece provided on the second interposed end face portion has a thickness such that the leg piece does not protrude from the second interposed end face portion in a thickness direction of the second interposed end face portion, wherein the leg pieces elevate a bottom edge of respective first and second interposed end face portions above the mounting plate.

2. The reactor according to claim 1, wherein the leg pieces are embedded in the bonding layer.

3. The reactor according to claim 1, further comprising: a casing in which the assembly is housed; and a potting resin with which the casing is filled, wherein a bottom portion of the casing serves also as the mounting plate.

4. The reactor according to claim 1, wherein at least one of the first interposed end face portion and the second interposed end face portion is provided with a plurality of leg pieces that are arranged at positions located at a distance from each other.

5. The reactor according claim 1, wherein the interposed insulating member is obtained by combining a first divided piece including the first interposed end face portion, and a second divided piece that is constituted by a portion of the interposed insulating member other than the first divided piece.

6. The reactor according to claim 5, wherein the coil includes a pair of wound portions that are arranged in parallel, and the interposed insulating member is obtained by combining: a U-shaped first divided piece that is constituted by the first interposed end face portion and a pair of inwardly interposed portions that respectively correspond to the pair of wound portions; and a plate-shaped second divided piece that is constituted by the second interposed end face portion, and is combined with the U-shaped first divided piece.

7. The reactor according to claim 5, wherein the coil includes a pair of wound portions that are arranged in parallel; and the interposed insulating member is obtained by combining: an L-shaped first divided piece that is constituted by the first interposed end face portion and an inwardly interposed portion that corresponds to one of the wound portions; and an L-shaped second divided piece that is constituted by the second interposed end face portion and an inwardly interposed portion that corresponds to the other one of the wound portions, the L-shaped second divided piece being combined with the L-shaped first divided piece.

8. The reactor according to claim 2, further comprising: a casing in which the assembly is housed; and a potting resin with which the casing is filled, wherein a bottom portion of the casing serves also as the mounting plate.

9. The reactor according to claim 2, wherein at least one of the first interposed end face portion and the second interposed end face portion is provided with a plurality of leg pieces that are arranged at positions located at a distance from each other.

10. The reactor according to claim 3, wherein at least one of the first interposed end face portion and the second interposed end face portion is provided with a plurality of leg pieces that are arranged at positions located at a distance from each other.

11. The reactor according to claim 2, wherein the interposed insulating member is obtained by combining a first divided piece including the first interposed end face portion, and a second divided piece that is constituted by a portion of the interposed insulating member other than the first divided piece.

12. The reactor according to claim 3, wherein the interposed insulating member is obtained by combining a first divided piece including the first interposed end face portion, and a second divided piece that is constituted by a portion of the interposed insulating member other than the first divided piece.

13. The reactor according to claim 4, wherein the interposed insulating member is obtained by combining a first divided piece including the first interposed end face portion, and a second divided piece that is constituted by a portion of the interposed insulating member other than the first divided piece.

* * * * *